US006132272A

United States Patent [19]

Rinzaki et al.

[11] Patent Number: 6,132,272

[45] Date of Patent: Oct. 17, 2000

[54] MARINE PROPULSION SYSTEM

[75] Inventors: Shoichi Rinzaki; Kouichi Oka, both of Wako, Japan

[73] Assignee: Honda Giken Kogyo Kabushiki Kaisha, Tokyo, Japan

[21] Appl. No.: 09/195,841

[22] Filed: Nov. 19, 1998

[30] Foreign Application Priority Data

Feb. 10, 1998 [JP] Japan ..... 10-028779

[51] Int. Cl.[7] ..... B63H 20/14

[52] U.S. Cl. ..... 440/75; 440/83

[58] Field of Search ..... 440/75, 83; 384/614

[56] References Cited

U.S. PATENT DOCUMENTS

| | | | |
|---|---|---|---|
| 3,966,284 | 6/1976 | Martin | 308/235 |
| 5,110,312 | 5/1992 | Higby | 440/75 |
| 5,716,247 | 2/1998 | Ogino | 440/75 |
| 5,921,826 | 7/1999 | Asberg et al. | 440/75 |

FOREIGN PATENT DOCUMENTS 60-163198 10/1985 Japan .

*Primary Examiner*—Sherman Basinger

*Attorney, Agent, or Firm*—Skjerven Morrill MacPherson LLP; Alan H. MacPherson

[57] ABSTRACT

In a marine propulsion system comprising: a drive shaft operably connected to an engine and carrying a drive bevel gear; a propeller shaft carrying a propeller; and a pair of driven bevel gears meshing with the drive bevel gear and selectively engageable with the propeller shaft via a clutch member, the propeller shaft is provided with an axially facing annular shoulder surface which faces a corresponding axially facing surface of one of the pair of driven bevel gears to determine an axial position of the propeller shaft, and a rolling thrust bearing is disposed between the mutually facing surfaces of the propeller shaft and the one of the pair of driven bevel gears. The rolling thrust bearing reduces the friction between the mutually facing surfaces of the propeller shaft and the one of the driven bevel gears when they rotate in opposite directions to each other, to thereby improve the durability of these component parts.

4 Claims, 3 Drawing Sheets

MARINE PROPULSION SYSTEM

TECHNICAL FIELD

The present invention relates to marine propulsion systems such as outboard or inboard marine engines, and more particularly to marine propulsion systems that are equipped with a shift mechanism utilizing a dog clutch for selecting a gear position between "forward," "reverse" and "neutral" positions.

BACKGROUND OF THE INVENTION

A marine propulsion system such as an outboard or inboard marine engine is used as a power source for a watercraft such as a boat. Some of the marine propulsion systems comprise: a drive shaft directly coupled to a crankshaft of an engine and provided with a drive bevel gear at its end; a pair of oppositely rotating driven bevel gears which mesh with and are driven by the drive bevel gear; a propeller shaft supported coaxially and rotateably with respect to the pair of driven bevel gears; and a clutch mechanism comprising a dog clutch for causing the propeller shaft to selectively mesh with either of the pair of driven bevel gears. (See for example Japanese Utility Model Laid-Open Publication (kokai) No. 60-163198.)

In the above marine propulsion system, the propeller shaft has a larger diameter portion defining axially outwardly facing shoulder surfaces at its both axial ends so that the shoulder surfaces face and slideably engage the axially inwardly facing surfaces of the pair of driven bevel gears to thereby determine the axial position of the propeller shaft. When rotating commonly with one of the driven bevel gears, depending on the position of the dog clutch of the clutch mechanism, the propeller shaft rotates in the opposite direction with respect to the other one of the driven bevel gears. This relative rotation of the propeller shaft with respect to either of the bevel gears generates a frictional heat and may cause abrasion of the slideably engaging surfaces. These problems are particularly severe with regards to the axially engaging surfaces of the propeller shaft and the reverse driven bevel gear which rotate in opposite directions to each other during the forward operation of the boat, where the traveling speed of the boat, and hence the rotation speed of the propeller shaft, are usually higher than during the reverse operation. Although these slideably engaging surfaces of the propeller shaft and the driven bevel gears usually consist of a so-called thrust metal, such as a sintered metal or a metal coated with synthetic resin, it is still desirable to further improve the durability of the propeller shaft and bevel gears particularly in high power marine propulsion systems in which the rotation speed of the propeller shaft is also high.

BRIEF SUMMARY OF THE INVENTION

In view of the above, a primary object of the present invention is to provide a marine propulsion system in which the friction between the axially facing surfaces of the propeller shaft and the driven bevel gears (particularly the reverse bevel gear) is reduced so that the durability of these component parts of the marine propulsion system is improved.

A second object of the present invention is to provide such a marine propulsion system in a simple and cost-effective manner.

According to the present invention, these and other objects can be accomplished by providing a marine propulsion system for a watercraft, comprising: a drive shaft extending generally vertically and carrying a drive bevel gear at its lower end; an internal combustion engine having a crankshaft drivingly connected to an upper end of the drive shaft; a propeller shaft extending generally horizontally and carrying a propeller at its one end; a pair of driven bevel gears supported rotatably and coaxially with respect to the propeller shaft and spaced apart from each other in an axial direction of the propeller shaft so that the pair of driven bevel gears mesh with the drive bevel gear to rotate in the opposite directions to each other; a clutch member fitted on the propeller shaft between the pair of driven bevel gears in such a manner that the clutch member is commonly rotateable with and axially freely moveable on the propeller shaft so that the clutch member can be selectively engaged with either of the pair of driven bevel gears; wherein the propeller shaft has an annular shoulder surface which faces an axially facing surface of one of the driven bevel gears to determine an axial position of the propeller shaft; and wherein the system further comprises a rolling thrust bearing between the axially facing surfaces of the propeller shaft and the one of the driven bevel gears.

The rolling thrust bearing preferably comprises: a plurality of rolling elements disposed around the propeller shaft; and a retaining means adapted to fit on the propeller shaft for retaining the plurality of rolling elements such that the rolling elements contact the axially facing surface of the one of the driven bevel gears. Typically, the plurality of rolling elements comprise plurality of balls or rollers.

Thus, the rolling thrust bearing provided between the axially mutually facing surfaces of the propeller shaft and one of the driven bevel gears greatly reduces the friction between these component parts when they rotate relatively to each other, to thereby effectively contribute to improving the total durability of the marine propulsion system The retaining means preferably consists of at least two separable parts so that the retaining means can be readily fitted on the propeller shaft at a predetermined axial position even when the predetermined position is axially flanked by larger diameter portions.

The rolling thrust bearing will be particularly beneficial if the one of the driven bevel gears is for a reverse operation of the watercraft.

BRIEF DESCRIPTION OF THE DRAWINGS

Now the present invention is described in the following with reference to the appended drawings, in which.

DETAILED DESCRIPTION OF THE PREFERRED EMBODIMENTS

Figure 1:
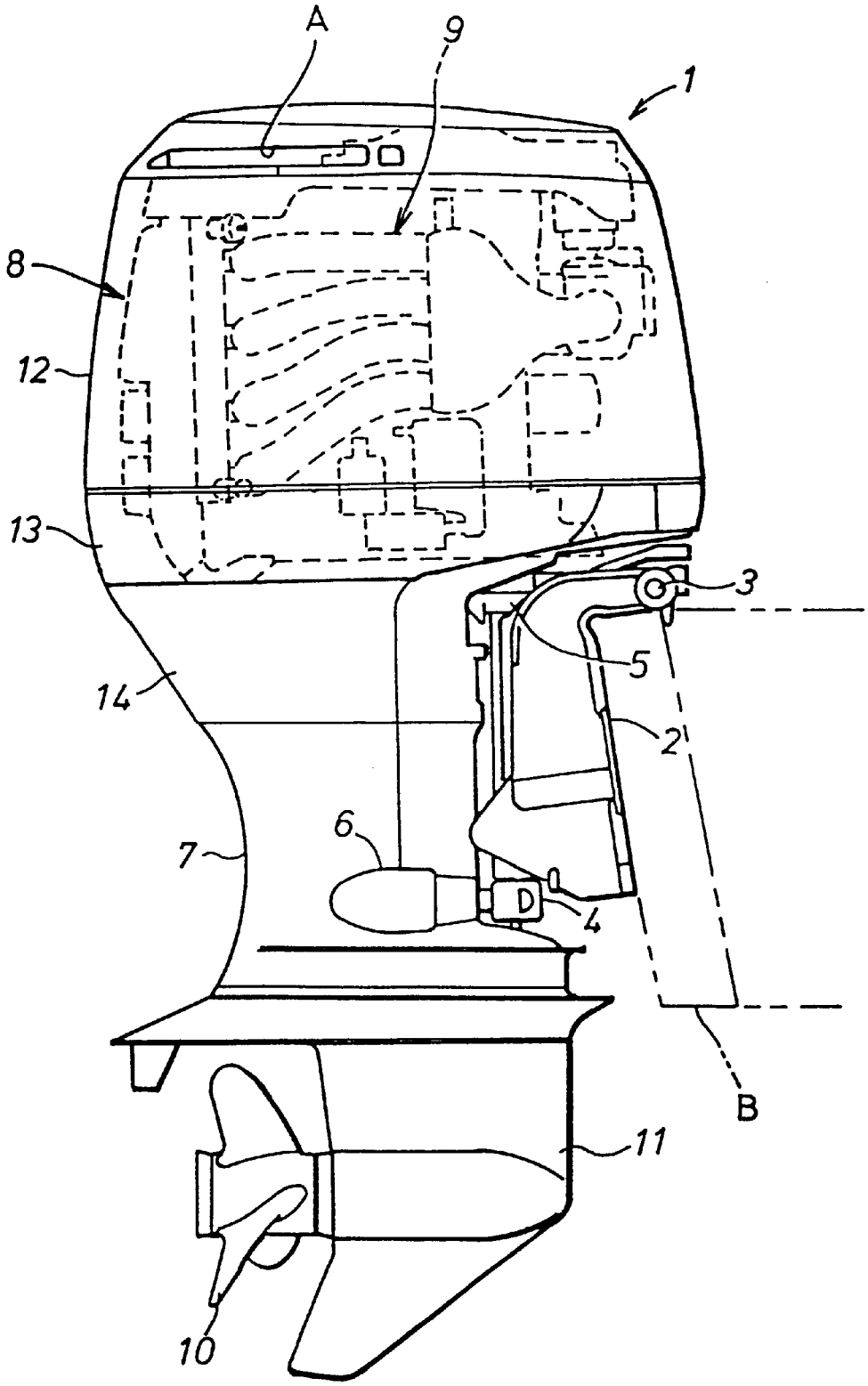
FIG. 1 is a general side view of an outboard motor to which the present invention-is applied.

FIG. 1 generally shows a side view of an outboard marine engine or outboard motor 1 to which the present invention is applied. The outboard motor 1 is mounted to a transom B of a boat or a watercraft via a stern bracket 2 equipped with clamping means.

To the stern bracket 2 is connected a swivel case 4 so as to be tiltable around a tilt shaft 3 extending laterally and horizontally with respect to the boat. Upper and lower mount arms 5 and 6 extend rearwardly from the upper and lower ends of the swivel case 4, and support an extension case 7 accommodating a drive shaft 15 (FIG. 2) so that the extension case 7 can swing laterally around a vertical swivel shaft provided to the swivel case 4.

An internal combustion engine 9 is placed above the extension case 7, and accommodated in an engine compartment 8. A gear case 11 is attached to a lower end of the extension case 7, and rotatably supports a propeller shaft 23 (FIG. 2) carrying a screw propeller 10.

The engine compartment 8 is primarily defined by an upper engine cover 12 for covering an upper part of the engine 9 and a lower engine cover or an under case 13 for covering a lower part of the engine 9. Further, another cover member or a skirt member 14 is provided so as to cover the joint portion between the under case 13 and the extension case 7. The upper engine cover 12 is provided with an air scoop A for communicating air to the internal combustion engine 9.

Figure 2:
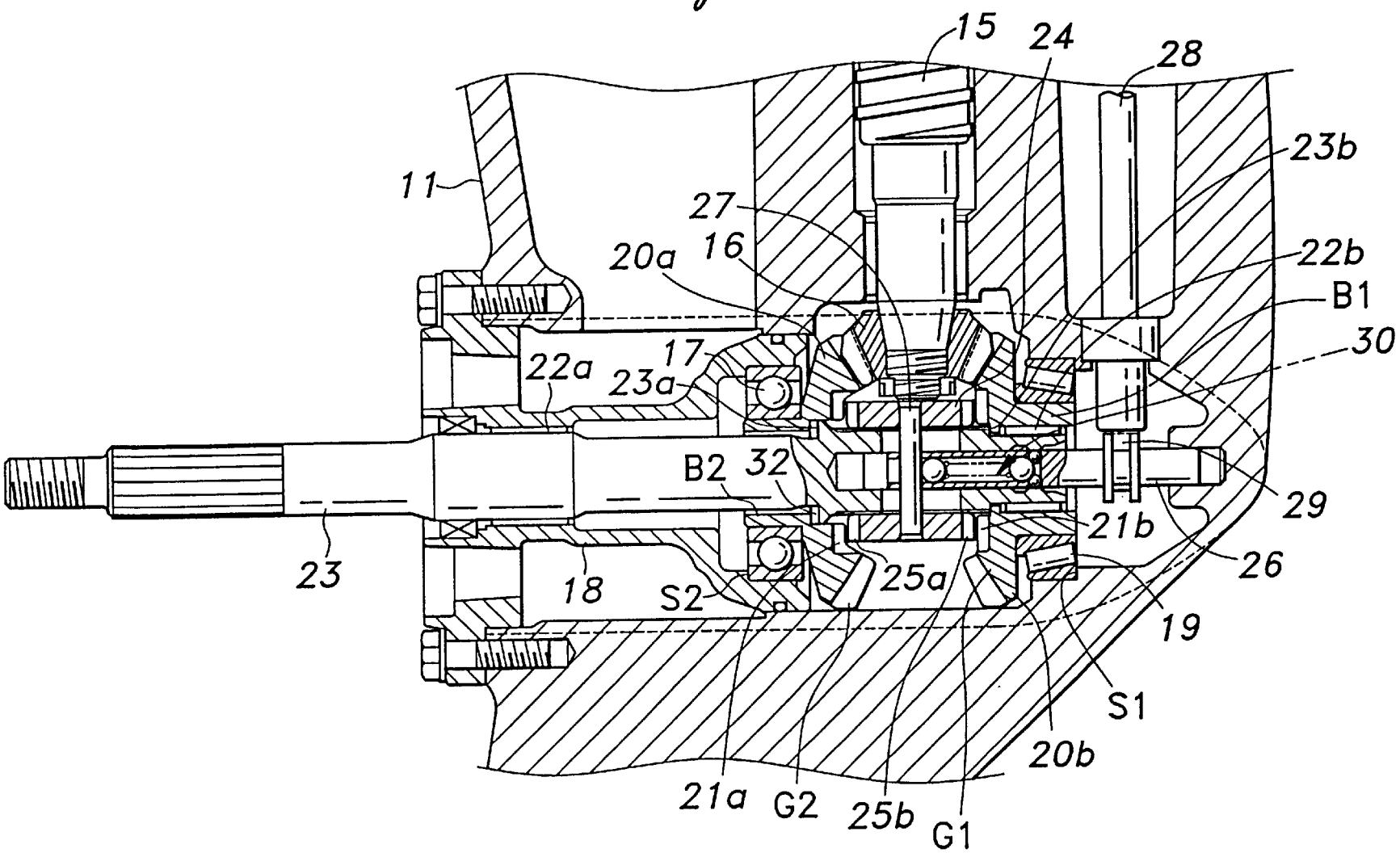
FIG. 2 is an enlarged cross-sectional view of a part of the outboard motor to which the present invention is applied.

Now, referring to FIG. 2, the mechanical structure inside the gear case 11 is described in detail hereinafter. The drive shaft 15 which is connected to a crankshaft of the engine 9 at its upper end and extends vertically downwardly inside the extension case 7 has a drive bevel gear 16 fixed at its lower end. The drive bevel gear 16 meshes with a pair of driven bevel gears 20*a* and 20*b* which are supported by radial bearings 17 and 19, respectively, so as to be coaxially rotateable with respect to the propeller shaft 23. In this embodiment, the radial bearing 17 supporting the rear-side driven bevel gear 20*a* consists of a ball bearing and is mounted to the bearing holder 18 which in turn is secured to the gear case 11. On the other hand, the radial bearing 19 for supporting the fore-side driven bevel gear 20*b* consists of an angular contact roller bearing which is mounted to the gear case 11. More specifically, the fore-side driven bevel gear 20*b* consists of a fore-side cylindrical base portion B1 and a rear-side gear portion G1, and an outer cylindrical surface of the base portion B1 and a forwardly facing annular surface of the gear portion G1 engage the angular contact roller bearing 19 which, in turn, is supported by a rearwardly facing shoulder surface of a step portion S1 formed in the gear case 11 so as to receive a forward thrust generated by the forward rotation of the propeller 10. The rear-side driven bevel gear 20*a* consists of a fore-side gear portion G2 and a rear-side cylindrical base portion B2, and an outer cylindrical surface of the base portion B2 and a rearwardly facing annular surface of the gear portion G2 engage the radial ball bearing 17 which, in turn, is supported by a forwardly facing shoulder surface of a step portion S2 formed in the gear holder 18 so as to receive a rearward thrust generated by the reverse rotation of the propeller 10. The gear holder 18 is secured to the gear case 11 by means of bolts around an opening formed in the rear side of the gear case 11. The axially inwardly facing surfaces of the pair of driven bevel gears 20*a* and 20*b* are provided with crown gears 21*a* and 21*b*, respectively.

The propeller shaft 23 carrying the propeller 10 is supported by needle bearings 22*a* and 22*b* rotatably and coaxially with respect to the pair of driven bevel gears 20*a* and 20*b*. The propeller shaft 23 has a larger diameter portion defining annular shoulder surfaces 23*a* and 23*b* which face the corresponding axially inwardly facing surfaces of the pair of driven bevel gears 20*a* and 20*b* to determine the axial position of the propeller shaft 23.

A dog clutch or a clutch member 24 is splined on the propeller shaft 23 between the pair of driven bevel gears 20*a* and 20*b* so that the clutch member 24 is commonly rotateable with and axially freely moveable on the propeller shaft 23. On both axial end surfaces of the clutch member 24 are formed crown gears 25*a* and 25*b* corresponding to the crown gears 21*a* and 21*b* formed on the driven bevel gears 20*a* and 20*b*, respectively.

The propeller shaft 23 has an axially extending bore through which extends a slide rod 26 so as to be axially slideable along the bore. This slide rod 26 is connected to the clutch member 24 with a pin 27 and its forward end portion extending out of the propeller shaft 23 is connected to a shifter rod 28.

The shifter rod 28 extends vertically in the swivel case 4, and although not shown in the drawings, is connected to a handle or other suitable means for allowing an operator to operate the shifter rod 28. The shifter rod 28 is provided at its lower end with an off-centered pin member 29 extending downwardly to fit into the space defined by two spaced-apart annular plates fixed on the slide rod 26, so that rotational movements of the shifter rod 28 around its vertical axis are converted into horizontal axial movements of the slide rod 26. The axial movements of the slide rod 26 lead to axial movements of the clutch member 24 on the propeller shaft 23. Thus, by operating the shifter rod 28 the operator can selectively cause the clutch member 24 to engage with one, the other, or neither of the driven bevel gears 20*a* and 20*b* to thereby select a desired shift position. The slide rod 26 comprises a detent mechanism 30 consisting of a spring and balls for giving the operator a detent feeling when any of the shift positions is selected.

In the illustrated marine propulsion system, the drive shaft 15 is directly coupled to the crankshaft of the internal combustion engine 9, and therefore rotates at all times during the operation of the engine 9. Accordingly, the pair of driven bevel gears 20*a* and 20*b*, which permanently mesh with the drive bevel gear 16 connected to the drive shaft 15, rotate at all times during the operation of the engine 9 in opposite directions to each other.

When the clutch member 24 is in its neutral position without meshing with either of the driven bevel gears 20*a* and 20*b*, the driving force from the engine 9 is not transmitted to the propeller shaft 23. When the clutch member 24 is moved to the right in FIG. 2 to mesh with the fore-side driven bevel gear 20*b*, the rotation of this bevel gear 20*b* is transmitted to the propeller shaft 23 via the clutch member 24, and thereby the propeller 10 rotates to generate a forward thrust. In other words, in the shown embodiment, the fore-side driven bevel gear 20*b* is preferably used for the forward operation of the boat. The generated forward thrust is transmitted from the forwardly facing shoulder surface 23*b* of the propeller shaft 23 to the rearwardly facing surface of the fore-side driven bevel gear 20*b*, and from there via the radial bearing 19 to the gear case 11. On the other hand, when the clutch member 24 is moved to the left of FIG. 2 to mesh with the rear-side driven bevel gear 20*a*, a rearward thrust is generated in a similar manner. The generated rearward thrust is transmitted from the rearwardly facing shoulder surface 23*a* of the propeller shaft 23 to the forwardly facing surface of the rear-side driven bevel gear 20*a*, and from there via the radial bearing 17 to the gear case 11.

Figure 3A:
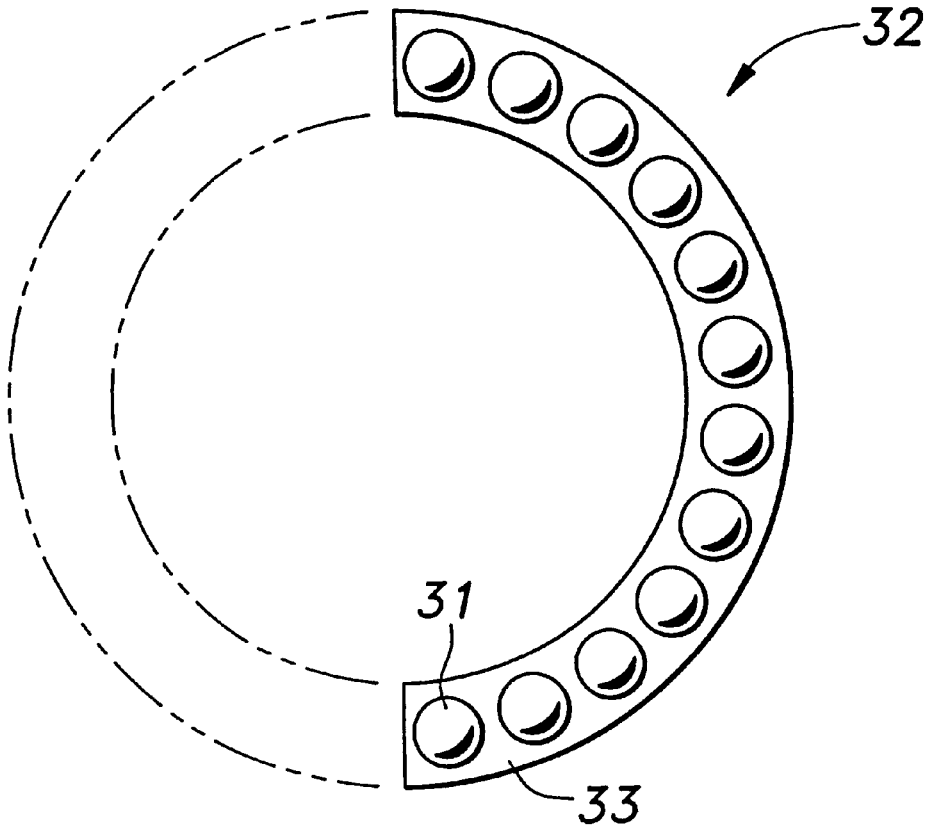
FIG. 3*a* is a plan view of an embodiment of a rolling thrust bearing according to the present invention and FIG. 3*b* is a side cross-sectional view of the rolling thrust bearing.
Figure 3B:
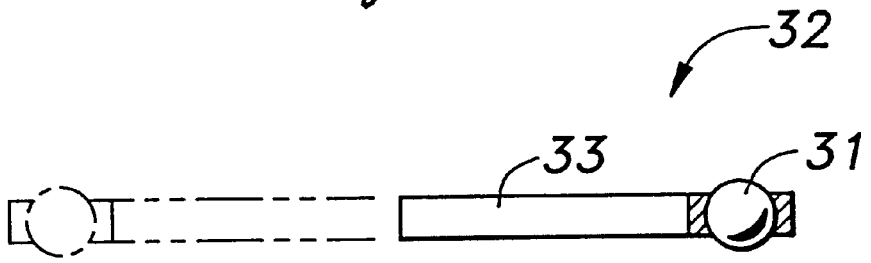

When during the reverse operation of the boat the rotation of the propeller 10 is accidentally stalled as a result of being entangled by some obstruction, a torque limiter will be activated. This causes a rapid increase in the relative rotation speed of the reverse driven bevel gear 20*a* with respect to the stalled propeller shaft 23, and may create a large friction between the axially facing surfaces of the propeller shaft 23 and the reverse driven bevel gear 20*a*. Moreover, during the forward operation of the boat, in which the reverse driven bevel gear 20*a* and the propeller shaft 23 rotate in opposite directions to each other, it is often desired to operate the engine 9 at a relatively high power with a high rotation speed of the propeller shaft and the bevel gears. This also leads to a high relative rotation speed of the rear-side reverse driven bevel gear 20*a* with respect to the propeller shaft 23. Therefore, according to the present invention, a rolling thrust bearing 32 such as shown in FIGS. 3*a* and 3*b* is interposed between the rearwardly facing shoulder surface 23*a* of the propeller shaft 23 and the forwardly facing surface of the reverse driven bevel gear 20*a* to reduce the friction therebetween. The thrust bearing 32 shown in the drawings comprises a plurality of balls 31 as rolling elements and an annular ball retainer 33 for retaining the balls 31 therein as retaining means. In the illustrated thrust bearing 32, the thickness of the ball retainer 33 is smaller than the diameter of the balls 31 so that each of the balls 31 can point-contact both of the forwardly facing surface of the reverse driven bevel gear 20*a* and the annular shoulder surface 23*a* of the propeller shaft 23. As also seen in FIGS. 3*a* and 3*b*, the ball retainer 33 preferably consists of two separable parts (or two halves) so that it can be readily fitted at a predetermined axial position on the propeller shaft 23 even though the predetermined position is axially flanked by larger diameter portions.

In the illustrated embodiment, no such rolling thrust bearing is provided between the axially facing surfaces of the fore-side driven bevel gear 20*b* and the propeller shaft 23 because they rotate in opposite directions in the reverse operation of the boat, which is normally quite rare in the boat operation. However, it is of course possible to provide a rolling thrust bearing as shown above between the axially facing surfaces of the fore-side driven bevel gear 20*b* and the propeller shaft 23 to reduce the friction therebetween.

As described above, according to the present invention the rolling thrust bearing provided between the axially mutually facing surfaces of the propeller shaft and the reverse driven bevel gear greatly reduces the friction between these component parts when they rotate relatively to each other, to thereby effectively contribute to improving the total durability of the marine propulsion system. Because the ball retainer consists of two separable parts, it can be readily fitted on the propeller shaft at a predetermined axial position even if the predetermined position is axially flanked by larger diameter portions.

Although the present invention has been described in terms of a preferred embodiment thereof, it will be obvious to a person skilled in the art that various alterations and modifications are possible without departing from the scope of the present invention which is set forth in the appended claims. For example, the rolling elements of the thrust bearing may comprise a plurality of rollers instead of balls. The retaining means may consist of more than two separable parts. Further, although in the preferred embodiment an outboard marine engine was shown, the present invention may be applicable to other types of marine propulsion systems such as inboard marine engines. Such modifications should fall within the scope of the present invention defined by the claims.

What we claim is:

1. A marine propulsion system for a watercraft, comprising:

a drive shaft extending generally vertically and carrying a drive bevel gear at its lower end;

an internal combustion engine having a crankshaft drivingly connected to an upper end of said drive shaft;

a propeller shaft extending generally horizontally and carrying a propeller at its one end;

a pair of driven bevel gears supported rotatably and coaxially with respect to said propeller shaft and spaced apart from each other in an axial direction of said propeller shaft so that said pair of driven bevel gears mesh with said drive bevel gear to rotate in opposite directions to each other;

a clutch member fitted on said propeller shaft between said pair of driven bevel gears in such a manner that said clutch member is commonly rotateable with and axially freely moveable on said propeller shaft so that said clutch member can be selectively engaged with either of said pair of driven bevel gears;

wherein said propeller shaft has an annular shoulder surface which faces an axially facing surface of one of said driven bevel gears to determine an axial position of said propeller shaft; and wherein said system further comprises a rolling thrust bearing fitted on a portion of said propeller shaft between said axially facing surfaces of said propeller shaft and said one of said driven bevel gears, said rolling thrust bearing comprising a plurality of rolling elements disposed around said propeller shaft, and a retaining means adapted to fit on said propeller shaft for retaining said plurality of rolling elements such that said rolling elements contact said axially facing surface of said one of said driven bevel gears, said retaining means consisting of two separable parts each having a semiannular shape.

2. A marine propulsion system according to claim 1, wherein said plurality of rolling elements comprise a plurality of balls.

3. A marine propulsion system according to claim 1, wherein said one of said driven bevel gears is for a reverse operation of said watercraft.

4. A marine propulsion system according to claim 1, wherein said portion of said propeller shaft on which said rolling thrust bearing is fitted is axially flanked by larger diameter portions of said propeller shaft.

* * * * *